US010650722B2

(12) United States Patent
Jian et al.

(10) Patent No.: US 10,650,722 B2
(45) Date of Patent: May 12, 2020

(54) DISPLAY PANEL AND DRIVING METHOD THEREOF

(71) Applicant: InnoLux Corporation, Miao-Li County (TW)

(72) Inventors: Zhi-Cheng Jian, Miao-Li County (TW); Yu-Hsin Feng, Miao-Li County (TW); Yu-Tse Lu, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/034,317

(22) Filed: Jul. 12, 2018

(65) Prior Publication Data

US 2019/0035323 A1 Jan. 31, 2019

(30) Foreign Application Priority Data

Jul. 28, 2017 (CN) ..... 2017 1 0633246

(51) Int. Cl.
*G09G 3/20* (2006.01)
*G09G 3/36* (2006.01)

(52) U.S. Cl.
CPC ..... *G09G 3/2092* (2013.01); *G09G 3/3666* (2013.01); *G09G 3/3677* (2013.01); *G09G 2300/0413* (2013.01); *G09G 2310/0221* (2013.01); *G09G 2320/0209* (2013.01)

(58) Field of Classification Search
CPC ... G09G 2300/0413; G09G 2310/0221; G09G 3/20; G09G 3/2092
USPC ..... 345/55, 698
See application file for complete search history.

(56) References Cited

U.S. PATENT DOCUMENTS

2005/0140578 A1* 6/2005 Yamazaki ..... G02F 1/13454 345/55
2013/0321499 A1* 12/2013 Park ..... G09G 3/20 345/698
2014/0071361 A1* 3/2014 Lv ..... G02F 1/13306 349/33
2016/0358574 A1* 12/2016 Hohjoh ..... G09G 3/3614
2018/0275445 A1* 9/2018 Katagiri ..... G02F 1/13452

* cited by examiner

*Primary Examiner* — Tony O Davis
(74) *Attorney, Agent, or Firm* — Winston Hsu

(57) ABSTRACT

A display panel includes a first circuit, a second circuit and a dummy gate line. The first circuit and the second circuit are disposed adjacent to each other and arranged along a first direction, and the first circuit and the second circuit are electrically insulated from each other. The dummy gate line extends along a second direction and is disposed between the first circuit and the second circuit, wherein the first direction is different from the second direction.

12 Claims, 15 Drawing Sheets

DISPLAY PANEL AND DRIVING METHOD THEREOF

CROSS REFERENCE TO RELATED APPLICATION

The present application claims the priority benefit of China application serial no. 201710633246.6, filed Jul. 28, 2017. The entirety of the above-mentioned patent application is hereby incorporated by reference herein and made a part of this specification.

BACKGROUND OF THE DISCLOSURE

1. Field of the Disclosure

The present disclosure relates to a display panel and a driving method thereof, and more particularly to a display panel and a driving method thereof capable of generating a single frame image by separately displaying different regions.

2. Description of the Prior Art

With the advancement of technology, the amount of pixels in a single frame image displayed by a display panel becomes higher, for example 4K2K(3840×2160) display panel or 8K4K(7680×4320) display panel, and accordingly an extremely high resolution image may be presented. However, as the amount of the pixels becomes higher, the amount of scan lines used to drive the pixels also becomes higher, and accordingly, longer time is needed to display the single frame image when the gate signals are sequentially transmitted to the gate lines, which results in insufficient charging time for each pixel and insufficient bandwidth of each input signal.

SUMMARY OF THE DISCLOSURE

According to an embodiment of the present disclosure, a display panel is provided, including a first circuit, a second circuit and a first dummy gate line. The first circuit and the second circuit are disposed adjacent to each other, wherein the first circuit and the second circuit are arranged along a first direction, and the first circuit and the second structure are electrically insulated from each other. The first dummy gate line extends along a second direction, wherein the first dummy gate line is disposed between the first circuit and the second circuit, and the first direction is different from the second direction.

According to another embodiment of the present disclosure, a driving method of a display panel is provided. First, a display panel is provided, wherein the display panel includes a first circuit and a second circuit, the second circuit and the first circuit are adjacent to each other, the first circuit and the second circuit are arranged along a first direction, the first circuit and the second circuit are electrically insulated from each other, the first circuit includes a plurality of first gate lines extending along a second direction, and a plurality of first data lines extending along the first direction, and the first data lines overlap the first gate lines. Next, a first current of one of the first gate lines in the first circuit closest to the second circuit is measured and a second current of one of the first gate lines in the first circuit not closest to the second circuit and not furthest from the second circuit is measured when the display panel is driven. And then, a difference between the first current and the second current is calculated.

Then, a plurality of data signals output to the data lines are modified based on the difference.

These and other objectives of the present disclosure will no doubt become obvious to those of ordinary skill in the art after reading the following detailed description of the embodiment that is illustrated in the various figures and drawings.

DETAILED DESCRIPTION

To provide a better understanding of the present disclosure, exemplary embodiments will be detailed as follows. The exemplary embodiments of the present disclosure are illustrated in the accompanying drawings to elaborate the contents and effects to be achieved. The exemplary embodiments are not intended to limit the scope of the present disclosure. It will be understood that when the terms "comprise" and/or "have" are used in the present disclosure, the referred feature, region, step, operation and/or device exist, but not exclude the existence or addition of one or plural feature, region, step, operation and/or device. It will be understood that when an element is referred to as being "on" another layer or substrate, it can be directly on the other element, or intervening elements may also be present. It will be understood that, although the terms first, second, third etc. may be used herein to describe various elements, components, sub-pixels, units, and/or layers, these elements, components, sub-pixels, units and/or layers should not be limited by these terms. These terms are used to distinguish one element, component, sub-pixel, unit and/or layer from another element, component, sub-pixel, unit and/or layer.

Figure 1:
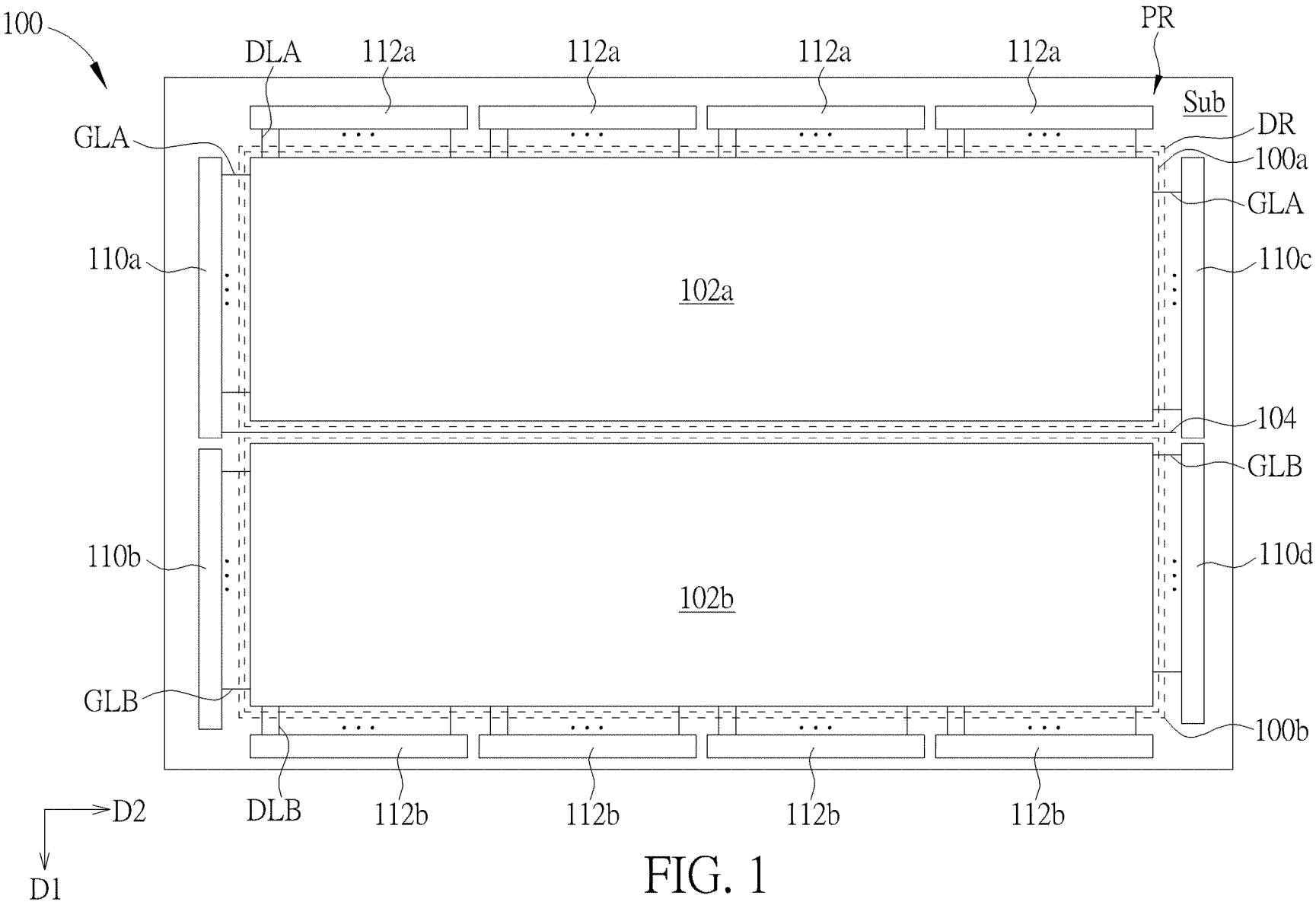
FIG. 1 is a schematic diagram illustrating top view of a display panel according to a first embodiment of the present disclosure.
Figure 2A:
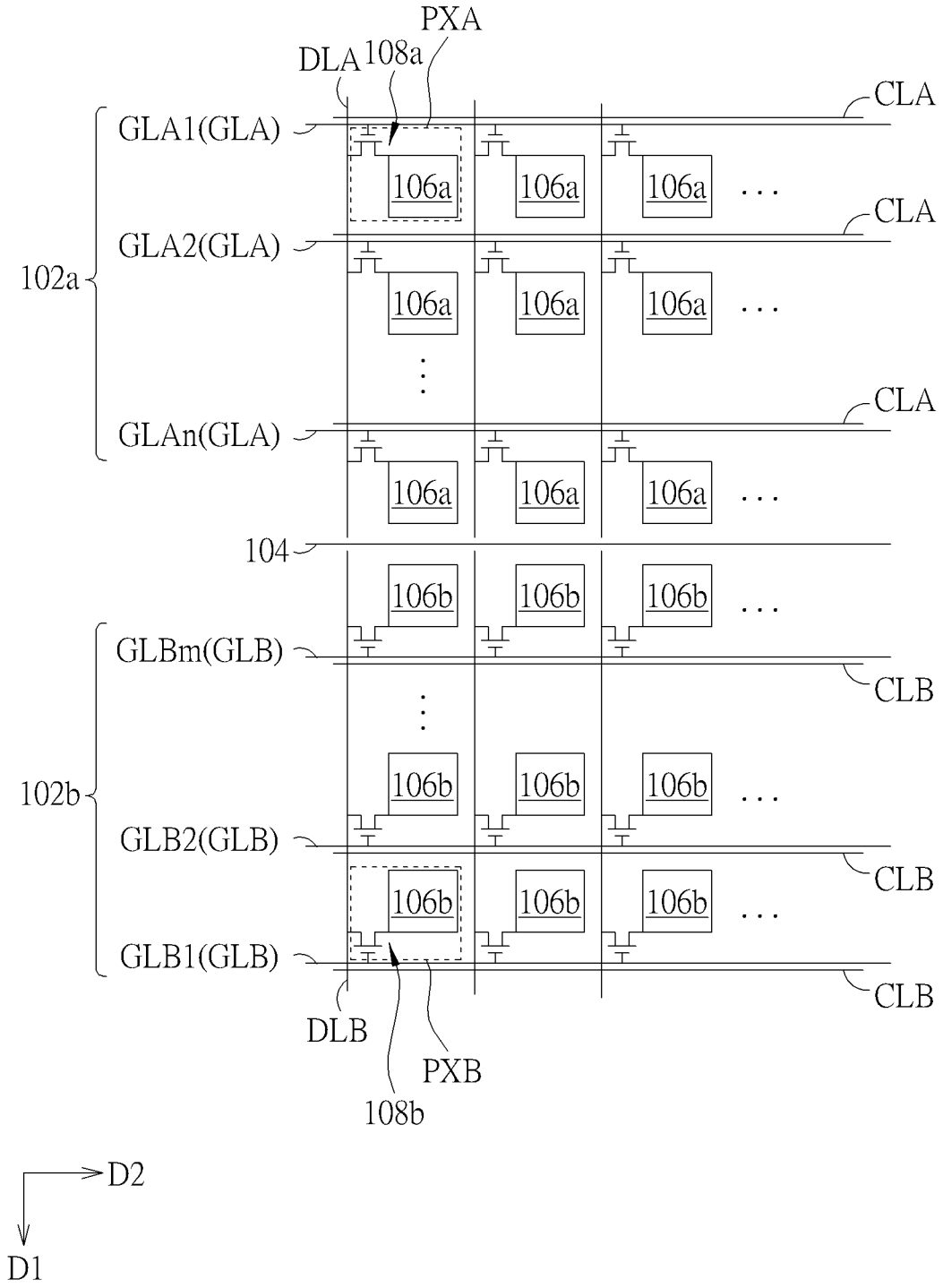
FIG. 2A is an enlarged schematic diagram illustrating a portion of the display panel in the display region according to a first embodiment of the present disclosure.

Refer to FIG. 1 and FIG. 2A. FIG. 1 is a schematic diagram illustrating top view of a display panel according to a first embodiment of the present disclosure, FIG. 2A is an enlarged schematic diagram illustrating a portion of the display panel in the display region according to a first embodiment of the present disclosure. As shown in FIG. 1, the display panel 100 may have a display region DR and a peripheral region PR, in which the display region DR has a first region 100*a* and a second region 100*b* that are adjacent to each other and arranged along a first direction D1. The display panel 100 may include a first circuit 102*a*, a second circuit 102*b* and a first dummy gate line 104, disposed on the substrate Sub. The first circuit 102*a* is disposed in the first region 100*a*, and the second circuit 102*b* is disposed in the second region 100*b*. The first circuit 102*a* and the second circuit 102*b* are disposed adjacent to each other, the first circuit 102*a* and the second circuit 102*b* are arranged along a first direction D1 and electrically insulated from each other, the first circuit 102*a* is used for displaying an image of the first region 100*a*, and the second circuit 102*b* is used for displaying an image of the second region 100*b*, so that the image of the first region 100*a* and the image of the second region 100*b* constitute a complete image frame. Furthermore, the first dummy gate line 104 extends along a second direction D2 and is disposed in the display region DR between the first circuit 102*a* and the second circuit 102*b*. For example, the first direction D1 may be substantially perpendicular to the second direction D2, and the term "perpendicular" described herein means the included angle between the first direction D1 and the second direction D2 may range from 85 degrees to 95 degrees. For another example, the first direction D1 may be different from the second direction D2.

It is worth to mention that, the first dummy gate 104 is disposed between the first circuit 102*a* and the second circuit 102*b*, so that through transmitting signals to the first dummy gate line 104, the coupling capacitance of a pixel PXA in the first circuit 102*a* that is close to the second circuit 102*b* and the coupling capacitance of a pixel PXB in the second circuit 102*b* that is close to the first circuit 102*a* may be compensated simultaneously. For this reason, the dark lines resulted from the difference between the coupling capacitances of the pixels PXA or the difference between the coupling capacitances of the pixels PXB may be effectively solved.

Specifically, as shown in FIG. 1 and FIG. 2A, the first circuit 102*a* may include a plurality of first gate lines GLA, a plurality of first data lines DLA and a plurality of first pixels PXA. The second circuit 102*b* may include a plurality of second gate lines GLB, a plurality of second data lines DLB and a plurality of second pixels PXB. In the first circuit 102*a*, each of the first gate lines GLA extends along the second direction D2, the first data lines DLA overlap the first gate lines GLA, the first pixels PXA in the same row are electrically connected to the same first gate line GLA, and the first pixels PXA in the first region 100*a* in the same column are electrically connected to the same first data line DLA. Accordingly, each of the first pixels PXA may display a required color and a corresponding brightness through each of the first gate lines GLA and each of the first data lines DLA, and the first pixels PXA in the first region 100*a* may display a corresponding image. Each of the first pixel rows and each of the first gate lines GLA may be arranged along the first direction D1 alternately. In the first circuit 102*a*, the first gate lines GLA may respectively be the 1st first gate line GLA1 to the nth first gate line GLAn which are sequentially arranged from an upper side of the substrate Sub to the first dummy gate line 104 (that is, arranged along a direction of an arrow of the first direction D1), where n is a positive integer.

In addition, in the second circuit 102*b*, each of the second gate lines GLB extends along the second direction D2, the second data lines DLB overlap the second gate lines GLB, the second pixels PXB in the same row are electrically connected to the same second gate line GLB, and the second pixels PXB in the second region 100*b* in the same column are electrically connected to the same second data line DLB. Accordingly, each of the second pixels PXB may display a required color and a corresponding brightness through each of the second gate lines GLB and each of the second data lines DLB, and the second pixels PXB in the second region 100*b* may display another corresponding image. Hence, the image displayed from the first region 100*a* and the image displayed from the second region 100*b* may form a complete frame image that has large number of pixels. In this embodiment, in order that the combining of the images displayed from the first region 100*a* and the second region 100*b* is not easy to be noticed by the user, the number of the first pixels PXA in the first region 100*a* and the number of the second pixels PXB in the second region 100*b* may be the same, and the number of the first data lines DLA may be the same as the number of the second data lines DLB, but the disclosure is not limited thereto. Each of the second pixel rows and each of the second gate lines GLB may be arranged along the second direction D2 alternately. In the second circuit 102*b*, the second gate lines GLB may respectively be the 1st second gate line GLB1 to the mth second gate line GLBm which are sequentially arranged from a lower side of the substrate Sub to the first dummy gate line 104 (that is, arranged along a direction opposite to the arrow of the first direction D1), where m is a positive integer. In this embodiment, in order to avoid the first circuit 102*a* and the second circuit 102*b* affecting each other, the first data lines DLA do not overlap the second gate lines GLB, the second data lines DLB do not overlap the first gate lines GLA, and the first data lines DLA and the second data lines DLB are separated from each other. Furthermore, each of the first pixels PXA may include a first pixel electrode 106*a* and a first transistor 108*a*. Each of the second pixels PXB may include a second pixel electrode 106*b* and a second transistor 108*b*. In each of the first transistors 108*a*, a gate of which is electrically connected to a corresponding one of the first gate lines GLA, a source of which is electrically connected to a corresponding one of the first data lines DLA, and a drain of which is electrically connected to a corresponding one of the first pixel electrodes 106*a*. In each of the second transistors 108*b*, a gate of which is electrically connected to a corresponding one of the second gate lines GLB, a source of which is electrically connected to a corresponding one of the second data lines DLB, and a drain of which is electrically connected to a corresponding one of the second pixel electrodes 106*b*. It should be noted that a connecting structure between the first transistors 108*a* and the first gate lines GLA and a connecting structure between the second transistors 108*b* and the second gate lines GLB are mirror-symmetric to each other with respect to the first dummy gate line 104, so that the coupling capacitances of the first pixels PXA in the first circuit 102*a* and the coupling capacitances of the second pixels PXB in the second circuit 102*b* can be equalized. Accordingly, the difference between the gray level of each of the first pixels PXA and the gray level of each of the second pixels PXB may be decreased. In this embodiment, each of the first transistors 108*a* is disposed between the corresponding first gate line GLA and the first dummy gate line 104, each of the second transistors 108*b* is disposed between the corresponding second gate lines GLB and the first dummy gate line 104, but the disclosure is not limited thereto.

Figure 2B:
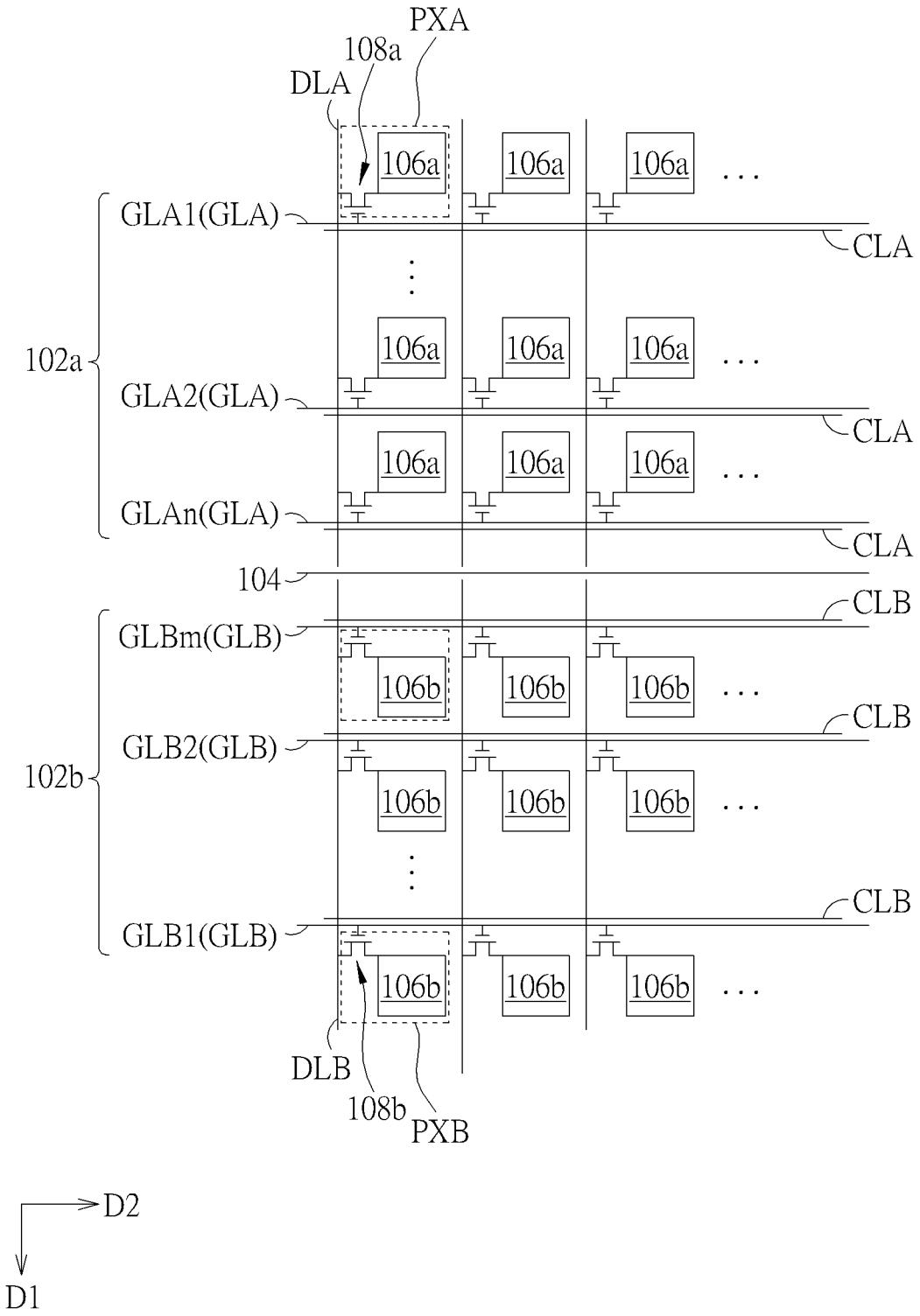
FIG. 2B is a schematic diagram illustrating top view of a display panel according to a variant embodiment of the first embodiment of the present disclosure.

In one variant embodiment, as shown in FIG. 2B, each of the first gate lines GLA may be disposed between the corresponding first transistor 108*a* and the first dummy gate line 104, and each of the second gate lines GLB may be disposed between the corresponding second transistor 108*a* and the first dummy gate line 104. It should be noted that each of the pixels may further include other elements, such as liquid crystal layer, common electrode, color filter, other elements or layers, and will not be redundantly described.

In this embodiment, the first circuit 102*a* may further include a plurality of first common lines CLA, and each of the first common lines CLA may be disposed adjacent to a corresponding one of the first gate lines GLA. The second circuit 102*b* may further include a plurality of second common lines CLB, and each of the second common lines CLB is disposed adjacent to a corresponding one of the second gate lines GLB. For example, each of the first gate lines GLA may be disposed between the corresponding first common line CLA and the corresponding first pixel row. Each of the second gate lines GLB may be disposed between the corresponding second common line CLB and the corresponding second pixel row. Accordingly, the first circuit 102*a* and the second circuit 102*b* may be symmetric to each other with respect to the first dummy gate line 104, but the disclosure is not limited thereto. In another embodiment, each of the first common lines CLA may also be disposed between the corresponding first gate line GLA and the corresponding first pixel row, or each first pixel row may be disposed between the corresponding first gate line GLA and the corresponding first common line CLA. Similarly, each of the second common lines CLB is disposed between the corresponding second gate line GLB and the corresponding second pixel row, or each second pixel row may be disposed between the corresponding second gate line GLB and the corresponding second common line CLB.

In addition, the display panel 100 may further include a first gate driver 110*a* and a second gate driver 110*b*, disposed in the peripheral region PR. The first gate driver 110*a* is disposed at a side of the first circuit 102*a* where ends of the first gate lines GLA extend out, so that the end of each of the first gate lines GLA may be electrically connected to the first gate driver 110*a*. Accordingly, the gate signals may be respectively transmitted to the first gate lines GLA at different times through the first gate driver 110*a*. The second gate driver 110*b* is disposed at a side of the second circuit 102*b* where ends of the second gate lines GLB extend out, so that the end of each of the second gate lines GLB may be electrically connected to the second gate driver 110*b*. Accordingly, the gate signals may be transmitted to the second gate lines GLB at different times respectively through the second gate driver 110*b*. Both the first gate driver 110*a* and the second gate driver 110*b* may be disposed between a side of the substrate Sub (such as left side) and the display region DR, or the first gate driver 110*a* and the second gate driver 110*b* may be respectively disposed between the display region DR and a side of the substrate Sub and between the display region DR and another side of the substrate Sub opposite to the side. Moreover, an end of the first dummy gate line 104 in this embodiment may extend into the peripheral region PR and electrically connected to the first gate driver 110*a*, so as to have a compensation signal through the first gate driver 110*a*, but the disclosure is not limited thereto. In another embodiment, an end of the first dummy gate line 104 may be electrically connected to the second gate driver 110*b* to have the compensation signal through the second gate driver 110*b*.

In this embodiment, the display panel 100 may further include a third gate driver 100*c* and a fourth gate driver 110*d*. The first circuit 102*a* is disposed between the first gate driver 110*a* and the third gate driver 110*c*, so that the first gate driver 110*a* and the third gate driver 110*c* may be respectively electrically connected to the two opposite sides of the first circuit 102*a*. The second circuit 102*b* is disposed between the second gate driver 110*b* and the fourth gate driver 110*d*, so that the second gate driver 110*b* and the fourth gate driver 110*d* may be respectively electrically connected to the two opposite sides of the second circuit 102*b*. This connecting structure is referred to a dual-side driving type. For example, in the first circuit 102*a*, one end of each of the odd-numbered first gate lines GLA1~GLA(n−1) in the first circuit 102*a* extends into the peripheral region PR and is electrically connected to the first gate driver 110*a*, and one end of each of the even-numbered first gate lines GLA2~GLA(n) extends into the peripheral region PR and is electrically connected to the third gate driver 110*c*, so that the gate signals may be provided by the first gate driver 110*a* and the third gate driver 110*c* and respectively transmitted to the first gate lines GLA1~GLAn at different times according to arranged sequence of the first gate lines GLA1~GLAn, but the disclosure not limited thereto. In the second circuit 102*b*, one end of each of the odd-numbered second gate lines GLB1~GLB(m−1) extends into the peripheral region PR and is electrically connected to the second gate driver 110*b*, and one end of each of the even-numbered second gate lines GLB2~GLB(m) extends into the peripheral region PR and is electrically connected to the fourth gate driver 110*d*, so that the gate signals may be provided by the second gate driver 110*b* and the fourth gate driver 110*d* and respectively transmitted to the second gate lines GLB1~GLBm at different times according to arranged sequence of the second gate lines GLB1~GLBm, but the disclosure is not limited thereto. In another embodiment, two ends of each first gate lines GLA1~GLA(n−1) are electrically connected to the first gate driver 110*a* and the third gate driver 110*c* respectively, and two ends of each second gate lines GLB2~GLB(m) are electrically connected to the second gate driver 110*b* and the fourth gate driver 110*d* respectively. In another embodiment, one end of the first dummy gate line 104 may also be electrically connected to the third gate driver 110*c* or the fourth gate driver 110*d*. In still another embodiment, the display panel may not include the third gate driver 110*c* and the fourth gate driver 110*d*, which is referred to a single-side driving type.

In addition, the display panel 100 may further include a plurality of first data drivers 112*a* and a plurality of second data drivers 112*b*, in which the first circuit 102*a* is disposed between the first data drivers 112*a* and the second circuit 102*b*, and the second circuit 102*b* is disposed between the second data drivers 112*b* and the first circuit 102*a*. The first data drivers 112*a* are electrically connected to the first data lines DLA, so as to transmit data signals to the first pixels PXA in the first region 100*a*, and the second data drivers 112*b* are electrically connected to the second data lines DLB, so as to transmit data signals to the second pixels PXB in the second region 100*b*.

Figure 3:
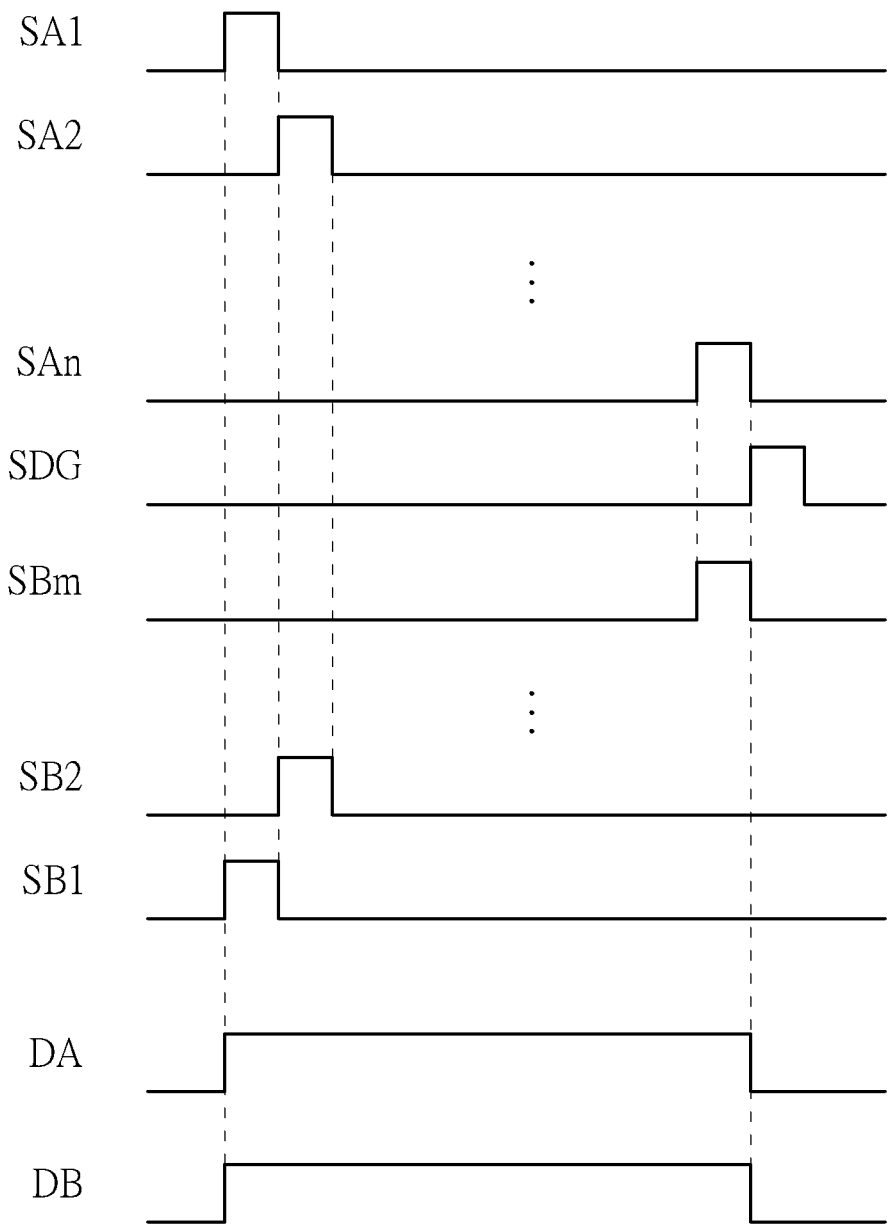
FIG. 3 is a timing sequence diagram illustrating the first gate signals provided to the first gate lines, the second gate signals provided to the second gate lines and the compensation signal provided to the first dummy gate line during displaying a single frame image according to the present disclosure.

The following description further details a driving method of the display panel of this embodiment and specifically mentions the approach to improve display quality. Please refer to FIG. 3 as well as FIG. 1 and FIG. 2A. FIG. 3 is a timing sequence diagram illustrating the first gate signals provided to the first gate lines, the second gate signals provided to the second gate lines and the compensation signal provided to the first dummy gate line during displaying a single frame image according to the present disclosure. As shown in FIG. 1, FIG. 2A and FIG. 3, in this embodiment, the first gate driver 110*a* and the third gate driver 110*c* provide the first gate signals SA1~SAn sequentially to the first gate lines GLA1~GLAn along the arranged sequence of the first gate lines GLA1~GLAn (that is along the direction of the arrow of the first direction D1). For example, the first gate driver 110*a* provides the first gate signals SA1, SA3 . . . SA(n−1) respectively to the odd-numbered first gate lines GLA1, GLA3 . . . GLA(n−1), and the third gate driver 110*c* provides the first gate signals SA2, SA4 . . . SAn respectively to the even-numbered first gate lines GLA2, GLA4 . . . GLAn. The second gate driver 110*b* and the fourth gate driver 110*d* provide the second gate signals SB1~SBn sequentially to the second gate lines GLBA1~GLBn along the arranged sequence of the second gate lines GLB1~GLBn (that is along the direction of the arrow of the first direction D1). For example, the second gate driver 110*b* provides the second gate signals SB1, SB3 . . . SB(n−1) respectively to the odd-numbered second gate lines GLB1, GLB3 . . . GLB(n−1), and the fourth gate driver 110*d* provides the second gate signals SB2, SB4 . . . SBn respectively to the even-numbered second gate lines GLB2, GLB4 . . . GLBn. In another embodiment, the sequence of the second gate signals SB1~SBm transmitted to the second gate lines GLB may be according to the arranged sequence of the second gate lines GLBm~GLB1, that is the second gate signals SB1~SBm are provided sequentially to the mth second gate line GLBm to the 1st second gate line GLB1 along the direction of the arrow of the first direction. It should be noted that the number of the first gate lines GLA may be equal to the number of the second gate lines GLB in this embodiment, that is n=m, hence the first gate signals SA1~SAn may be synchronized with the second gate signals SB1~SBm respectively. For example, each of the first gate signals SA1~SAn may be the same as a corresponding one of the second gate signals SB1~SBm, such that the discriminability between the image of the first region 100*a* and the image of the second region 100*b* may be reduced. In this embodiment, the first data driver 112*a* may provide a plurality of first data signals DA respectively to the first data lines DLA, and the second data driver 112*b* may provide a plurality of second data signals DB respectively to the second data lines DLB. In FIG. 3, one of the first data signals DA provided to one of the first data lines DLA and one of the second data signals DB provided to one of second data lines DLB are as an example, but the disclosure is not limited thereto. As shown in FIG. 3, taking the first pixels PXA and the second pixels PXB displaying the same gray level for example, the first data signal DA has an equal voltage when the first data signal DA is at the times respectively corresponding to the first gate signals SA1~SAn, the second data signal DB has an equal voltage when the second data signal DB is at the times respectively corresponding to the second gate signals SB1~SBm, and the voltage of the first data signal DA may be the same as the voltage of the second data signal DB.

Figure 4:
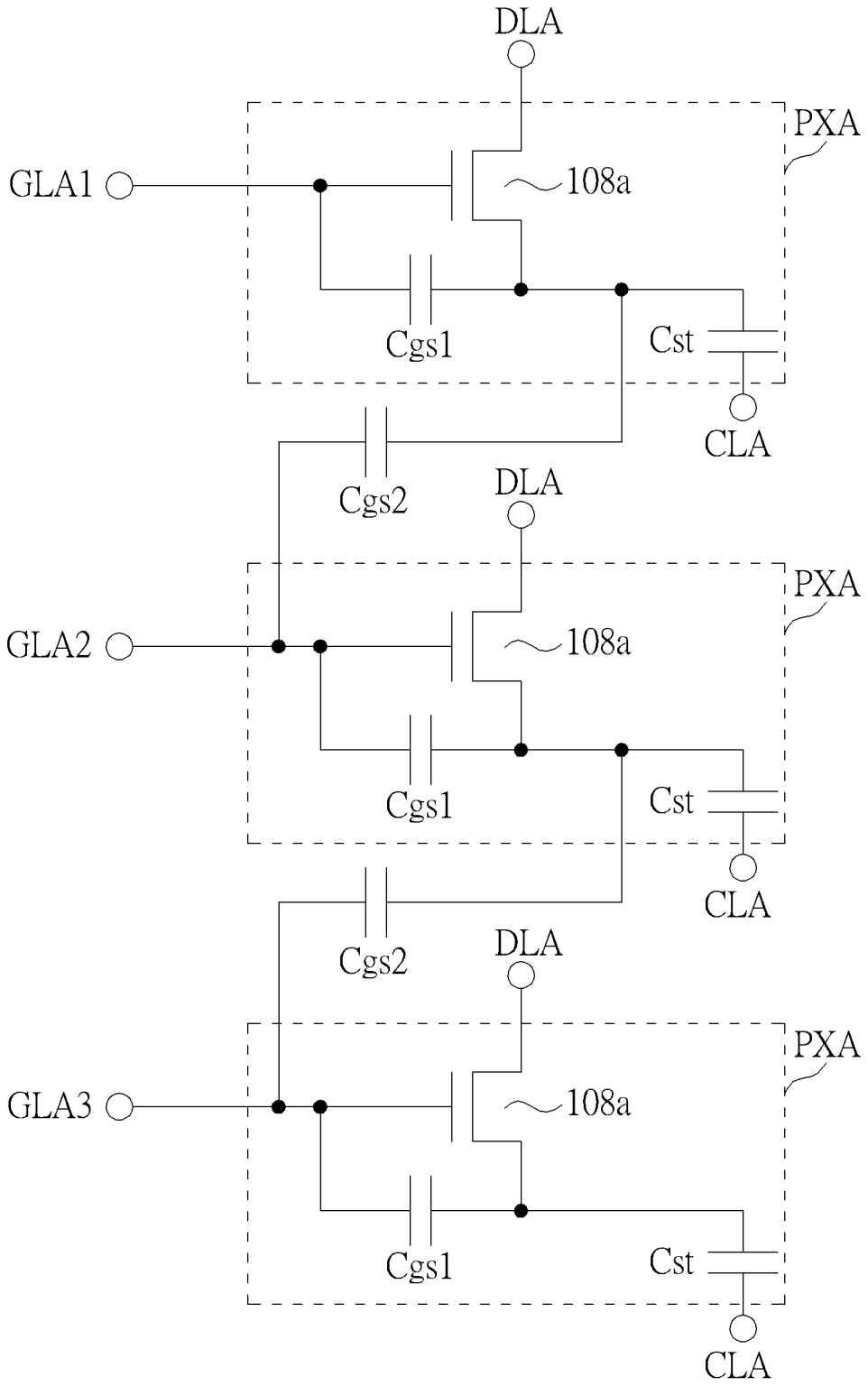
FIG. 4 is a circuit diagram illustrating the first pixels corresponding to the same first data line and three adjacent first gate lines according to the present disclosure.

Please further refer to FIG. 4. FIG. 4 is a circuit diagram illustrating the first pixels corresponding to the same first data line and three adjacent first gate lines according to the present disclosure. As shown in FIG. 2A and FIG. 4, besides the first transistor 108*a*, each of the first pixels PXA may further include a parasitic capacitor Cgs1 between the gate and the source of the first transistor 108*a* and a storage capacitor Cst, and a coupling capacitor Cgs2 may exist between each of the first gate lines GLA and the first pixel electrode 106*a* in the pixel row adjacent to the corresponding first pixel PXA. For example, with respect to the first pixels PXA corresponding to the same first data line DLA, each of the first pixel electrodes 106*a* of the three adjacent first pixels PXA and the corresponding first common line CLA have the storage capacitor Cst between them, and also, one coupling capacitor Cgs2 may further exist between the 2nd first gate line GLA2 and the first pixel electrode 106*a* corresponding to the 1st first gate line GLA1, when the 2nd first gate line GLA2 is disposed between the first pixel electrode 106*a* corresponding to the 1st first gate line GLA1 and the first pixel electrode 106*a* corresponding to the 2nd first gate line GLA2. Similarly, another coupling capacitor Cgs2 may further exist between the 3rd first gate line GLA3 and the first pixel electrode 106*a* corresponding to the 2nd first gate line GLA2. The rest may be deduced by analogy. The coupling capacitor Cgs2 may exist between the nth first gate line GLAn and the first pixel electrode 106*a* corresponding to the (n−1)th first gate line GLA(n−1). Since the coupling capacitances between the storage capacitors Cst respectively corresponding to the 2nd first gate line GLA2 to the (n−1)th first gate line GLA(n−1) that are not the first gate line GLA closest to the second circuit 102*b* and not the first gate line GLA furthest from the second circuit 102*b* and the other devices are substantially the same, the first pixels PXA respectively corresponding to the 2nd first gate line GLA2 to the (n−1)th first gate line GLA(n−1) that are not closest to the second circuit 102*b* and not furthest from the second circuit 102*b* may have substantially the same feed-through effect, and the same gray level may be displayed by the first pixels PXA when the same data signal is provided. It should be noted that, since the first circuit 102*a* and the second circuit 102*b* are mirror symmetric to each other, not only the coupling capacitances between the storage capacitors Cst respectively corresponding to the 2nd second gate line GLB2 to the (m−1)th second gate line GLB(m−1) that are not the second gate line GLB closest to the first circuit 102*a* and not the second gate line GLB furthest from the first circuit 102*a* and the other devices are substantially the same, but also the coupling capacitances between the storage capacitors Cst respectively corresponding to the 2nd first gate line GLA2 to the (n−1)th first gate line GLA(n−1) and the other devices may be the same as the coupling capacitances between the storage capacitors Cst respectively corresponding to the 2nd second gate line GLB2 to the (m−1)th second gate line GLB(m−1) and the other devices. For this reason, the first pixels PXA and the second pixels PXB may display the same gray level when the same data signal is provided, thereby decreasing the difference between the gray level of the image of the first region 100*a* and the gray level of the image of the second region 100*b*.

Furthermore, please refer to FIG. 3. In order to decrease the difference between the coupling capacitance of the first pixel PXA corresponding to the nth first gate line GLAn and in the middle of display region DR and the coupling capacitance of one of the first pixels PXA corresponding to the 2nd first gate line GLA2 to the (n−1)th first gate line GLA(n−1) that are not the first gate line GLA closest to the second circuit 102*b* and not the first gate line GLA furthest from the second circuit 102*b*, and in order to decrease the difference between the coupling capacitance of the second pixel PXB corresponding to the mth second gate line GLBm and the coupling capacitance of one of the second pixels PXB corresponding to the 2nd second gate line GLB2 to the (m−1)th second gate line GLB(m−1) that are not the second gate line GLB closest to the first circuit 102*a* and not the second gate line GLB furthest from the first circuit 102*a* to reduce the difference between the displayed the gray levels, which is to solve the dark line issue, the first dummy gate line 104 is disposed between the nth first gate line GLAn and the mth second gate line GLBm, and the compensation signal SDG is provided to the first dummy gate line 104 in this embodiment to simultaneously compensate the coupling capacitance of the first pixel PXA corresponding to the nth first gate line GLAn and the coupling capacitance of the second pixel PXB corresponding to the mth second gate line GLBm. For this reason, the coupling capacitance of the first pixel PXA corresponding to the nth first gate line GLAn may be the same as the coupling capacitance of the first pixel PXA corresponding to one of the 2nd first gate line GLA2 to the (n−1)th first gate line GLA(n−1), and the coupling capacitance of the second pixel PXB corresponding to the mth second gate line GLBm may be the same as the coupling capacitance of the second pixel PXB corresponding to one of the 2nd second gate line GLB2 to the (m−1)th second gate line GLB(m−1), such that each of the first pixels PXA corresponding to the nth first gate line GLAn may display the same gray level as each of the first pixels PXA corresponding to the 2nd first gate line GLA2 to the (n−1)th first gate line GLA(n−1), and each of the second pixels PXB corresponding to the mth second gate line GLBm may display the same gray level as each of the second pixels PXB corresponding to the second gate line GLB2 to the (m−1)th second gate line GLB(m−1). Thus, the problem of the horizontal dark lines can be solved. In this embodiment, the compensation signal SDG and each of the first gate signals SA1~SAn may have same voltage and same pulse width, and the compensation signal SDG is started immediately after the first gate signal SAn and the second gate signal SBm are finished.

According to the above, the display panel 100 in this embodiment may solve the problem of different gray levels displayed by different display regions or the problem of the existence of the horizontal dark lines in the middle of the pixels through the symmetry of the first circuit 102*a* and the second circuit 102*b* or through disposing the first dummy gate line 104.

Figure 5:
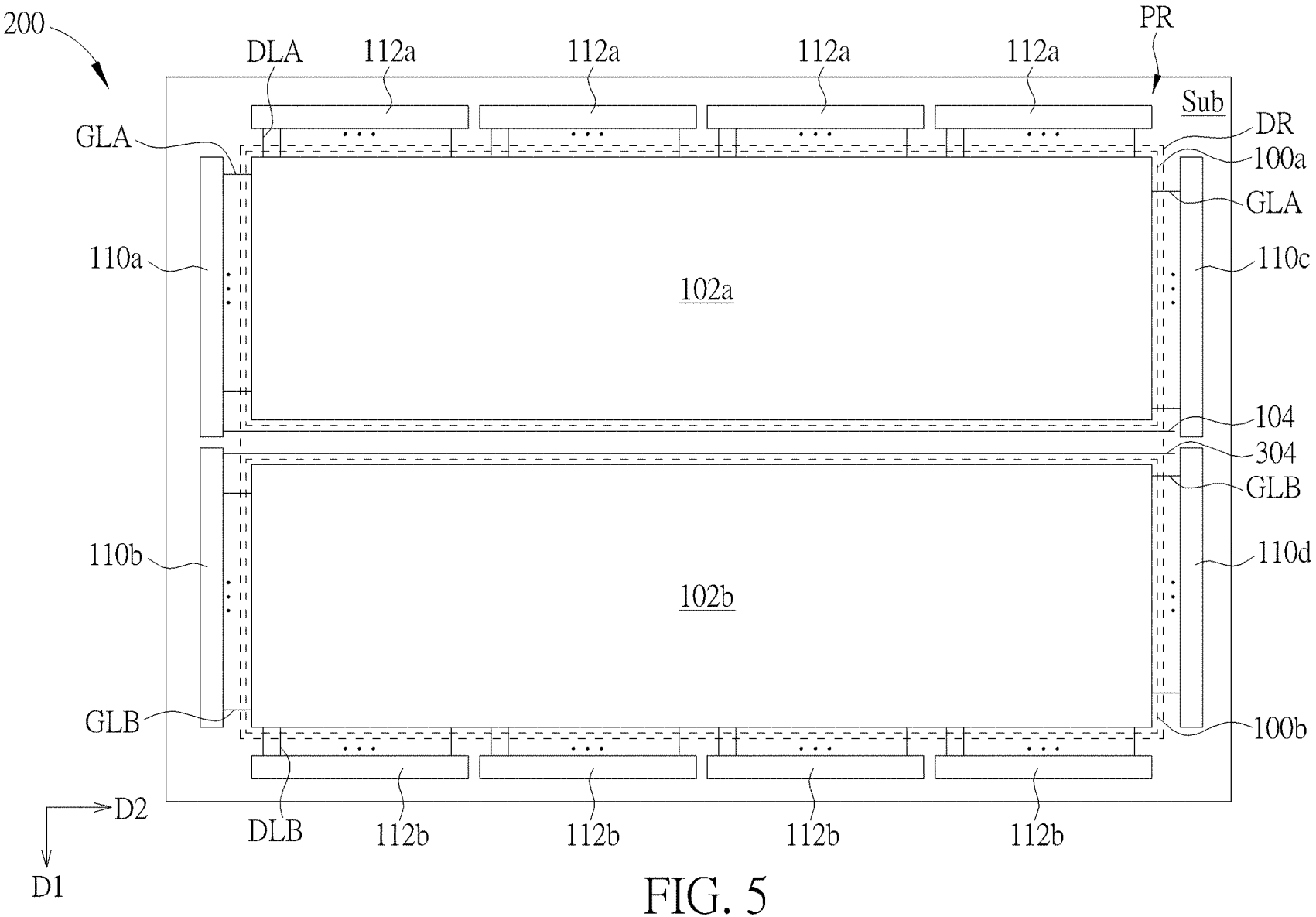
FIG. 5 is a schematic diagram illustrating top view of a display panel according to still another variant embodiment of the first embodiment of the present disclosure.

In still another variant embodiment, as shown in FIG. 5, the display panel 200 may further include a second dummy gate line 304 extending along the second direction D2, and the second dummy gate line 304 is disposed between the first circuit 102*a* and the second circuit 102*b*. In this variant embodiment, the first dummy gate line 104 and the second dummy gate line 304 may be respectively electrically connected to the first gate driver 110*a* and second gate driver 110*b* different from each other. In another embodiment, one end of the second dummy gate line 304 may be electrically connected to the fourth gate driver 110*d*, but the disclosure is not limited thereto.

Figure 6A:
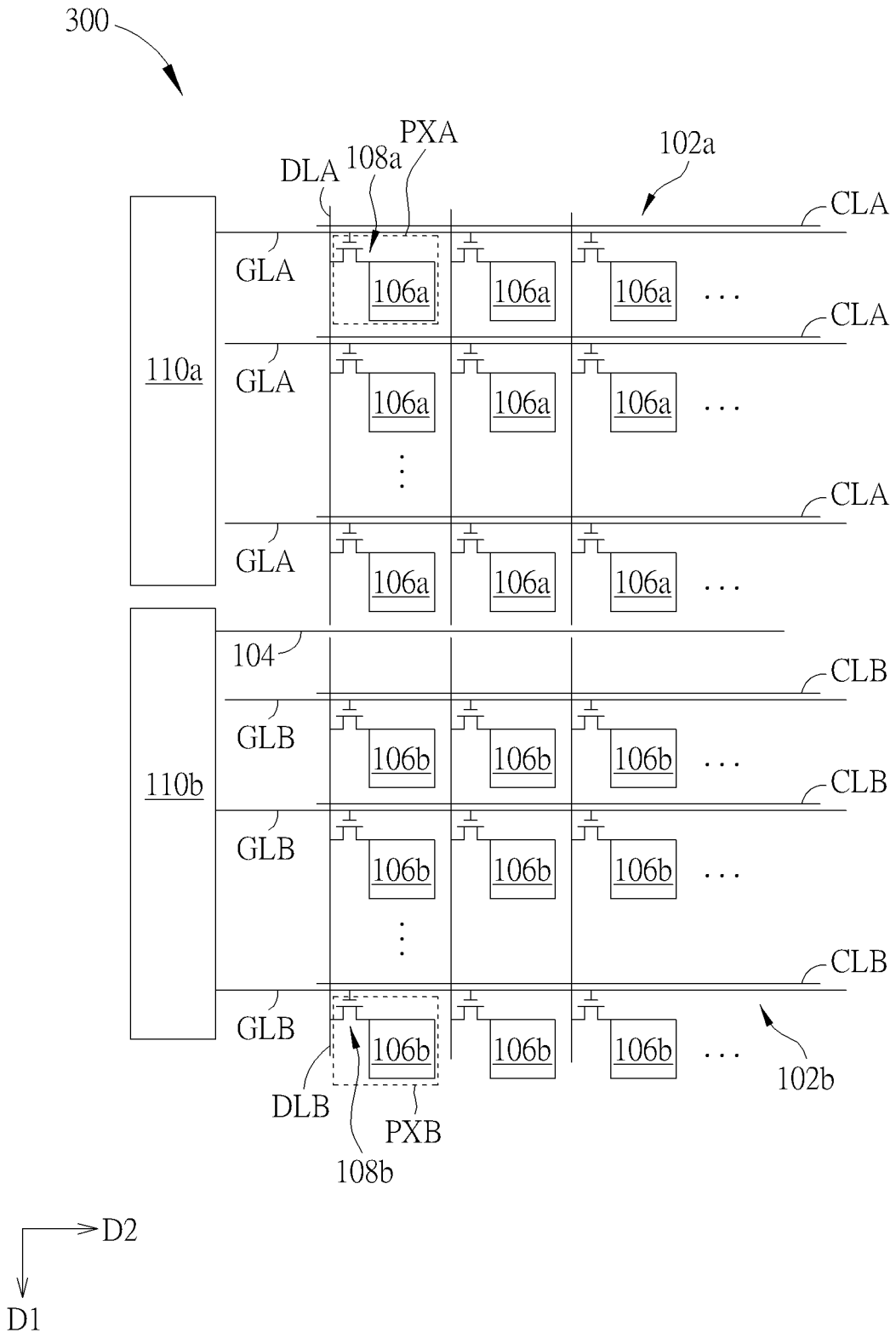
FIG. 6A is a schematic diagram illustrating top view of a display panel according to still another variant embodiment of the first embodiment of the present disclosure.
Figure 6B:
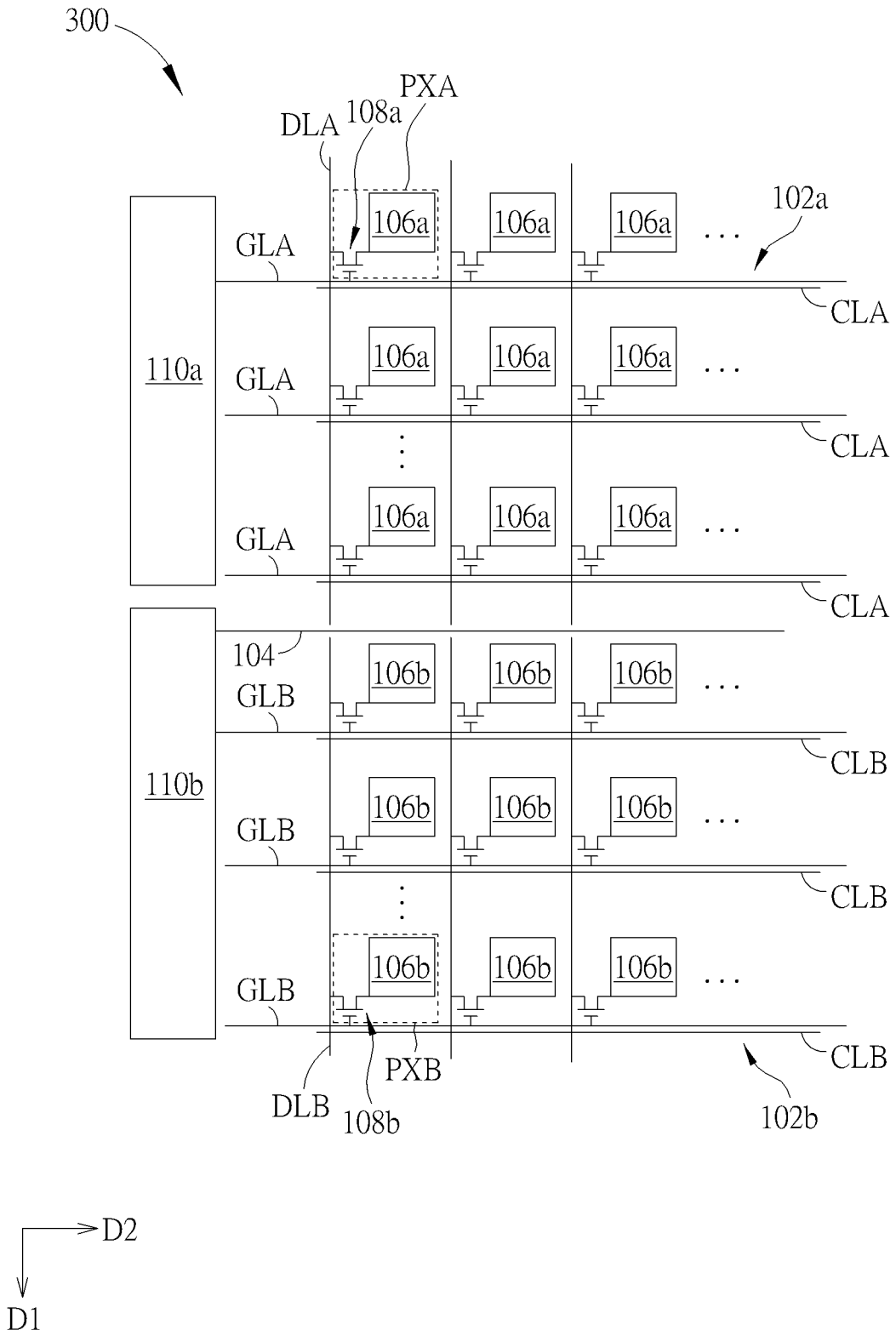
FIG. 6B is a schematic diagram illustrating top view of a display panel according to still another variant embodiment of the first embodiment of the present disclosure.

In still another variant embodiment, as show in FIG. 6A, as compared to the above-mentioned first embodiment, the connecting structure of the first transistors 108*a* connected to the first gate lines GLA and the connecting structure of the second transistors 108*b* connected to the second gate lines GLB may be the same in the display panel 300 of this variant embodiment. In this variant embodiment, each of the first transistors 108*a* may be disposed between the corresponding first gate line GLA and the first dummy gate line 104, each of the second gate lines GLB may be disposed between the corresponding second transistor 108*b* and the first dummy gate line 104. In one embodiment, the first dummy gate line 104 may be electrically connected to the second gate driver 110*b*. In another variant embodiment, the first dummy gate line 104 may be electrically connected to the first gate driver 110*a*. In still another variant embodiment, as shown in FIG. 6B, each of the first gate lines GLA is disposed between the corresponding first transistor 108*a* and the first dummy gate line 104, and each of the second transistors 108*b* is disposed between the corresponding second gate line GLB and the first dummy gate line 104.

Figure 7:
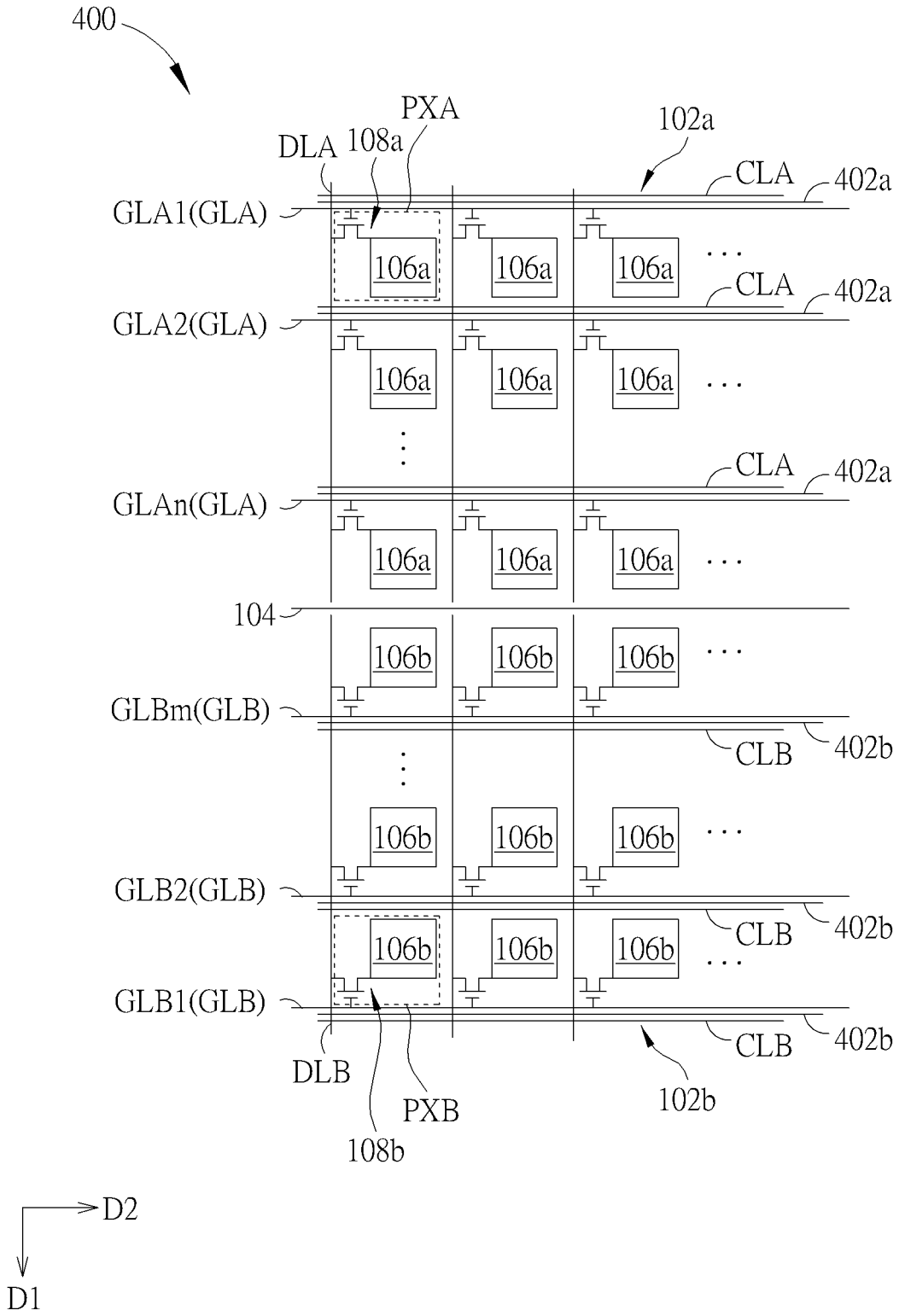
FIG. 7 is a schematic diagram illustrating top view of a display panel according to still another variant embodiment of the first embodiment of the present disclosure.

In still another variant embodiment, as shown in FIG. 7, the first circuit 102*a* of the display panel 400 in this variant embodiment may further include a plurality of first voltage compensation lines 402*a* extending along the second direction D2. The first voltage compensation lines 402*a* are arranged along the first direction D1 at intervals, and each of the first voltage compensation line 402*a* corresponds to one of the first gate lines GLA. Each of the first voltage compensation lines 402*a* may be adjacent to the corresponding first gate line GLA. The second circuit 102*b* may further include a plurality of second voltage compensation lines 402*b* extending along the second direction D2. The second voltage compensation lines 402*a* are arranged along the first direction D1 at intervals, and each of the second voltage compensation lines 402*b* corresponds to one of the second gate lines GLB. Each of the second voltage compensation line 402*b* may be adjacent to the corresponding second gate line GLB. In this variant embodiment, each of the first gate lines GLA is disposed between the corresponding voltage compensation line 402*a* and the first dummy gate line 104, and each of the second gate lines GLB is disposed between the corresponding second voltage compensation line 402*b* and the first dummy gate line 104, but the disclosure is not limited thereto.

The method of the present disclosure for solving the problem of different gray levels displayed from different display regions or the problem of the dark lines is not limited to the above embodiment. Hereinafter, other embodiments of this disclosure are provided. To simplify the description and clarify the dissimilarities among different embodiments, the same component would be labeled with the same symbol in the following, and the identical features will not be redundantly described.

Figure 8:
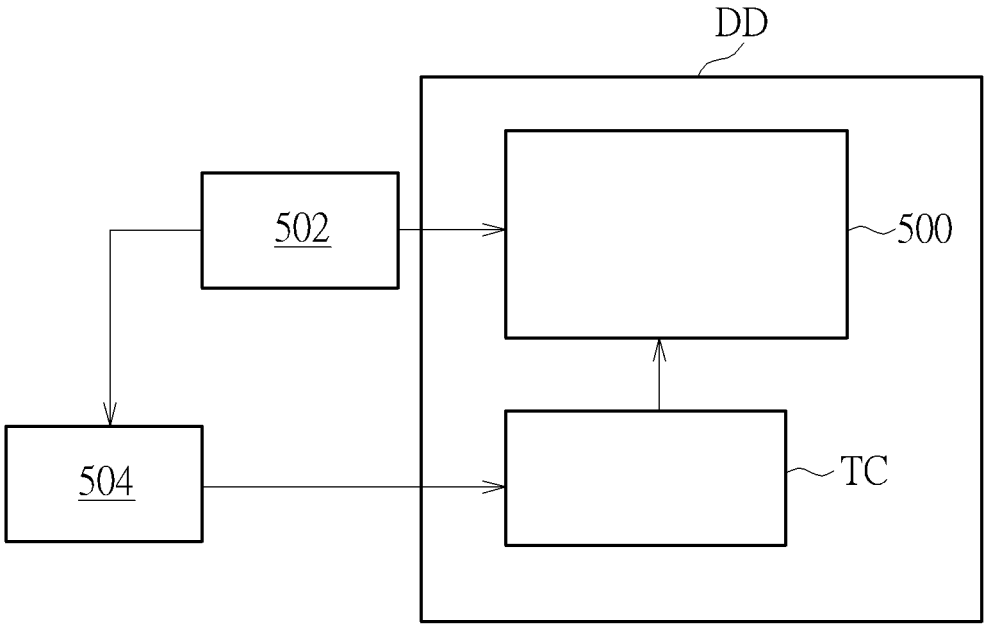
FIG. 8 to FIG. 9 are schematic diagrams illustrating a driving method of the display panel according to a second embodiment of the present disclosure.
Figure 9:
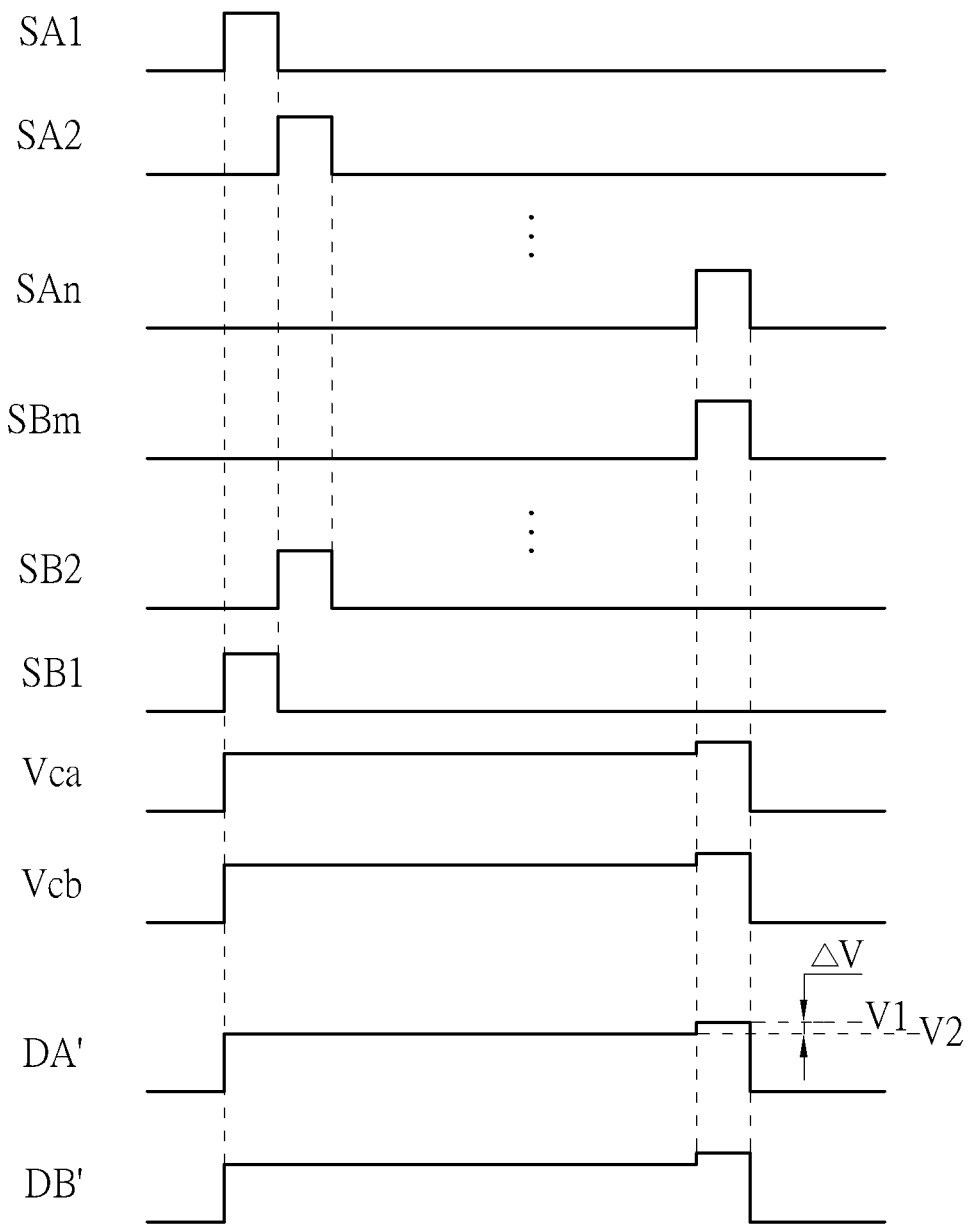

Please refer to FIG. 8 to FIG. 9, and also refer to FIG. 2A. FIG. 8 to FIG. 9 are schematic diagrams illustrating a driving method of the display panel according to a second embodiment of the present disclosure. As shown in FIG. 2A and FIG. 9, besides including the display panel 500, the display device DD may further include a timing controller TC for controlling the timing of each of the first gate signals SA1~SAn provided to the first gate lines GLA and the timing of each of the second gate signals SB1~SBm provided to the second gate lines GLB and for controlling the voltage of each of the first data signals DA and the voltage of each of the second data signals DB. The display panel 500 may be disposed in the display region DR, as shown in FIG. 1, and will not be described redundantly. In another embodiment, the display panel 500 may not include the dummy gate line.

In this embodiment, first, the plurality of first gate signals SA1~SAn are sequentially provided to the first gate lines GLA along the arranged sequence of the first gate lines GLA1~GLAn, the plurality of second gate signals SB1~SBm are sequentially provided to the second gate lines GLB along the arranged sequence of the second gate lines GLB1~GLBm, the first data signal DA is provided to the first data line DLA, and the second data signal DB is provided to the second data line DLB. Afterwards, an image sensor 502 is used to detect the frame image displayed by the display panel 500, that is, to detect the difference between the gray level of the first pixel PXA closest to the second region 100*b* and the gray level of the first pixel PXA not closest to the second region 100*b* and not furthest from the second region 100*b*. The coupling capacitance of the first pixel PXA closest to the second region 100*b* is different from the coupling capacitance of the first pixel PXA not closest to the second region 100*b* and not furthest from the second region 100*b*, so that the voltage of the first common voltage signal Vca at the timing corresponding to the first gate signal SAn is different from the voltages of the first common voltage signal Vca at the timings corresponding to other first gate signals SA1~SA(n−1). Hence, the voltage difference between the first data signal DA and the first common voltage signal Vca at the timing corresponding to the first gate signal SAn is decreased, and a dark line occurs. Similarly, the voltage of the second common voltage signal Vcb at the timing corresponding to the second gate signal SBm is also different from the voltages of the second common voltage signal Vcb at the timings corresponding to other second gate signals SB1~SB(m−1). Therefore, through the image sensor 502, the brightness difference between the dark lines and non-dark lines may be detected, that is, gray level difference. In this embodiment, the gray level difference may be calculated by the computer and through computing image difference captured by the image sensor 502. And then, the gray level difference may be input into the timing controller TC through a jig 504. Thereafter, as shown in FIG. 9, based on the gray level difference, the timing controller TC can modify the plurality of first data signals output to the first data lines DLA when the first gate line GLAn closest to the second circuit 102*b* receives the first gate signal SAn again. For example, each of the first data signals DA may be modified to a third data signal DA'. When the first pixels PXA corresponding to the third data signals DA' display the same gray level, a first voltage V1 of each of the third data signals DA' corresponding to the first gate line GLAn closest to the second circuit 102*b* (that is, corresponding to the first gate line SAn) is greater than or less than a second voltage V2 of each of the third gate signals DA' corresponding to one of the first gate lines GLA2~GLA(n−1) (that is, corresponding to the first gate signal SA2~SA(n−1)) not closest to the second circuit 102*b* and not furthest from the second circuit 102*b*. It is worth to mention that the first voltages V1 of the third data signals DA' corresponding to the first gate signal SAn may be modified based on the difference detected above, such that the difference between the image displayed by the first pixels PXA closest to the second circuit 102*b* and the images displayed by the first pixels PXA not closest to the second circuit 102*b* and not furthest from the second circuit 102*b* may be compensated, thereby decreasing the gray level difference and the occurrence of the dark lines. For example, the first voltage V1 is greater than the second voltage V2, and a difference ΔV between the first voltage V1 and the second voltage V2 can serve as a compensation value, but the disclosure is not limited thereto. In other words, the first voltages V1 of the third data signals DA' corresponding to the first gate signal SAn may be increased to be greater than the second voltages V2 of the third data signals DA' corresponding to other first gate signals SA1~SA(n−1), so as to compensate the deficiency of the coupling capacitance and solve the problem of the dark lines. Similarly, each of the second data signals DB may be modified to a fourth data signal DB'. When the second pixels PXB corresponding to the fourth data signals DB' display the same gray level, a third voltages V3 of each of the fourth data signals DB' corresponding to the second gate line GLBm closest to the first circuit 102*a* are greater than or smaller than a fourth voltages V4 of each of the fourth data signals DB' corresponding to one of the second gate lines GLB2~GLA(m−1) not closest to the first circuit 102*a* and not furthest from the first circuit 102*a*.

Figure 10:
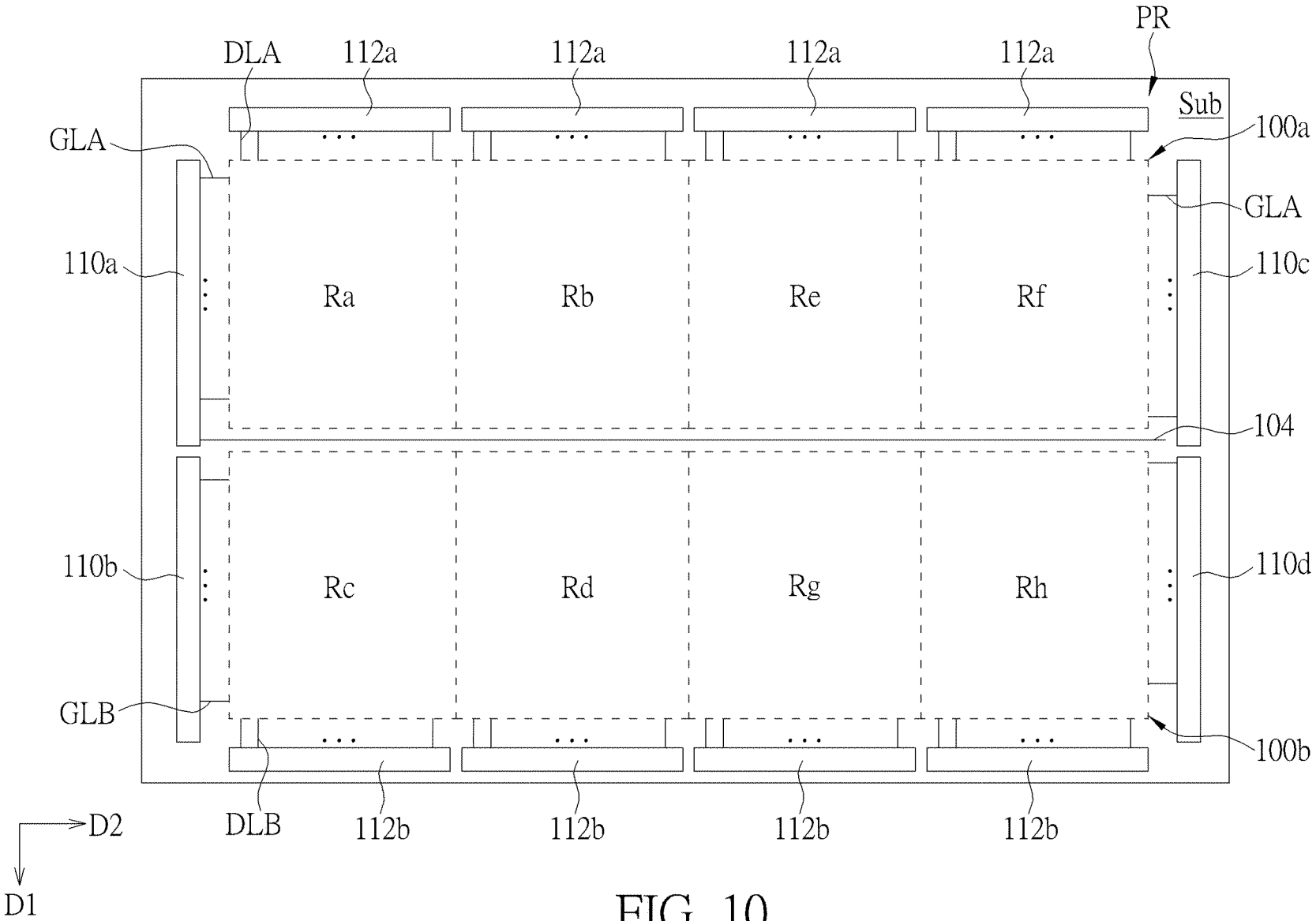
FIG. 10 is a schematic diagram illustrating top view of sub regions of the first region and sub regions of the second region according to the present disclosure.
Figure 11:
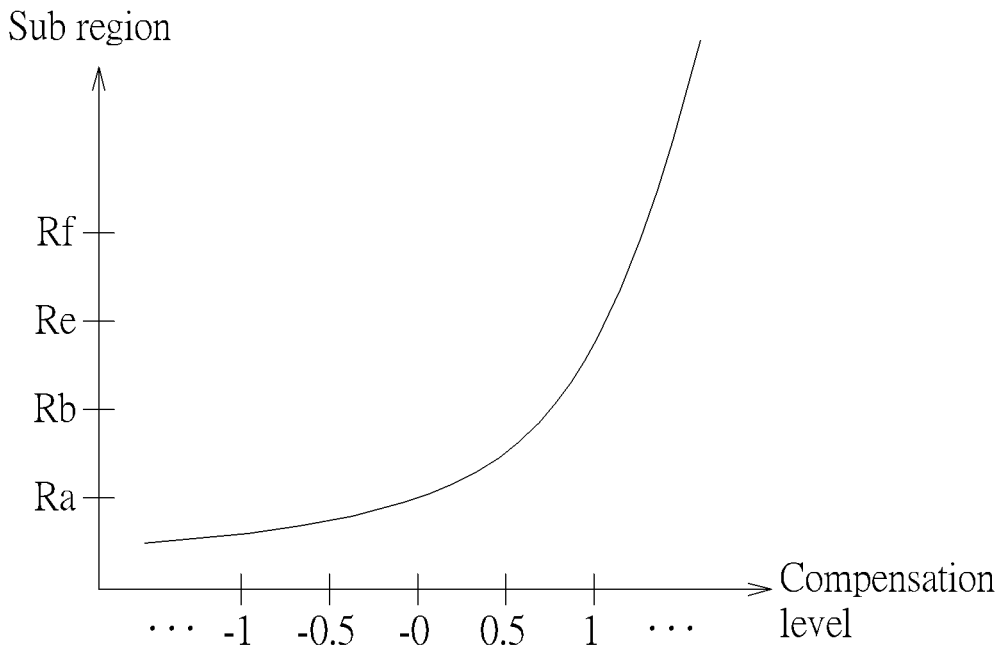
FIG. 11 is a schematic diagram illustrating the relationship between the sub region and the compensation level.

In this embodiment, the compensation value increased by the timing controller TC may be a product of a compensation coefficient and a compensation level, where the compensation level is equal to 1±N, and N may be 0.5, 1, 2, 3 and so on. The compensation coefficient may be determined according to a distance spaced between the first pixel PXA that needs compensation and the first gate driver 110*a*. Please refer to FIG. 10. FIG. 10 is a schematic diagram illustrating top view of sub regions of the first region and sub regions of the second region according to the present disclosure. As shown in FIG. 10, the first region 100*a* may include a first sub region Ra and a second sub region Rb, and the first sub region Ra is closer to the first gate driver 110*a* than the second sub region Rb. The compensation coefficient corresponding to the first pixel PXA in the first sub region Ra and closest to the second region 100*b* may be less than or equal to the compensation coefficient corresponding to the first pixel PXA in the second sub region Rb and closest to the second region 100*b*. For example, the compensation value corresponding to the first pixel PXA in the first sub region Ra and closest to the second region 100*b* may be 1 gray level value, and the compensation value corresponding to the first pixel PXA in the second sub region Rb and closest to the second region 100*b* may be 1 or 2 gray level values. In this embodiment, the first pixel PXA in the first sub region Ra and the first pixel PXA in the second sub region Rb are electrically connected to different first data drivers 112*a* through different first data lines DLA. In this embodiment, the first region 100*a* may further include a fifth sub region Re and a sixth sub region Rf. When the display panel 500 is the single-side driving type, the compensation value corresponding to the fifth sub region Re and the compensation value corresponding to the sixth sub region Rf may be greater than or equal to the compensation value corresponding to the second sub region Rb and may be increased in order, as shown in FIG. 11 for instance. The second region 100*b* may include a third sub region Rc, a fourth sub region Rd, a seventh sub region Rg and an eighth sub region Rh. The compensating method of the second region 100*b* may be the same as that of the first region 100*a*, and will not be described redundantly. In this embodiment, the second pixels PXB in the third sub region Rc and the second pixels PXB in the fourth sub region Rd are electrically connected to different second data drivers 112*b* through different second data lines DLB.

Figure 12:
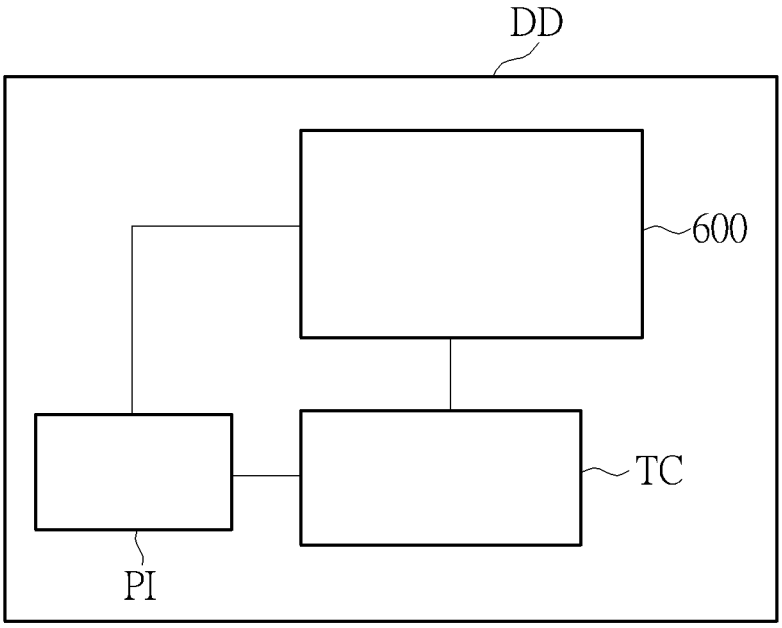
FIG. 12 to FIG. 13 are schematic diagrams illustrating a driving method of the display panel according to a third embodiment of the present disclosure.
Figure 13:
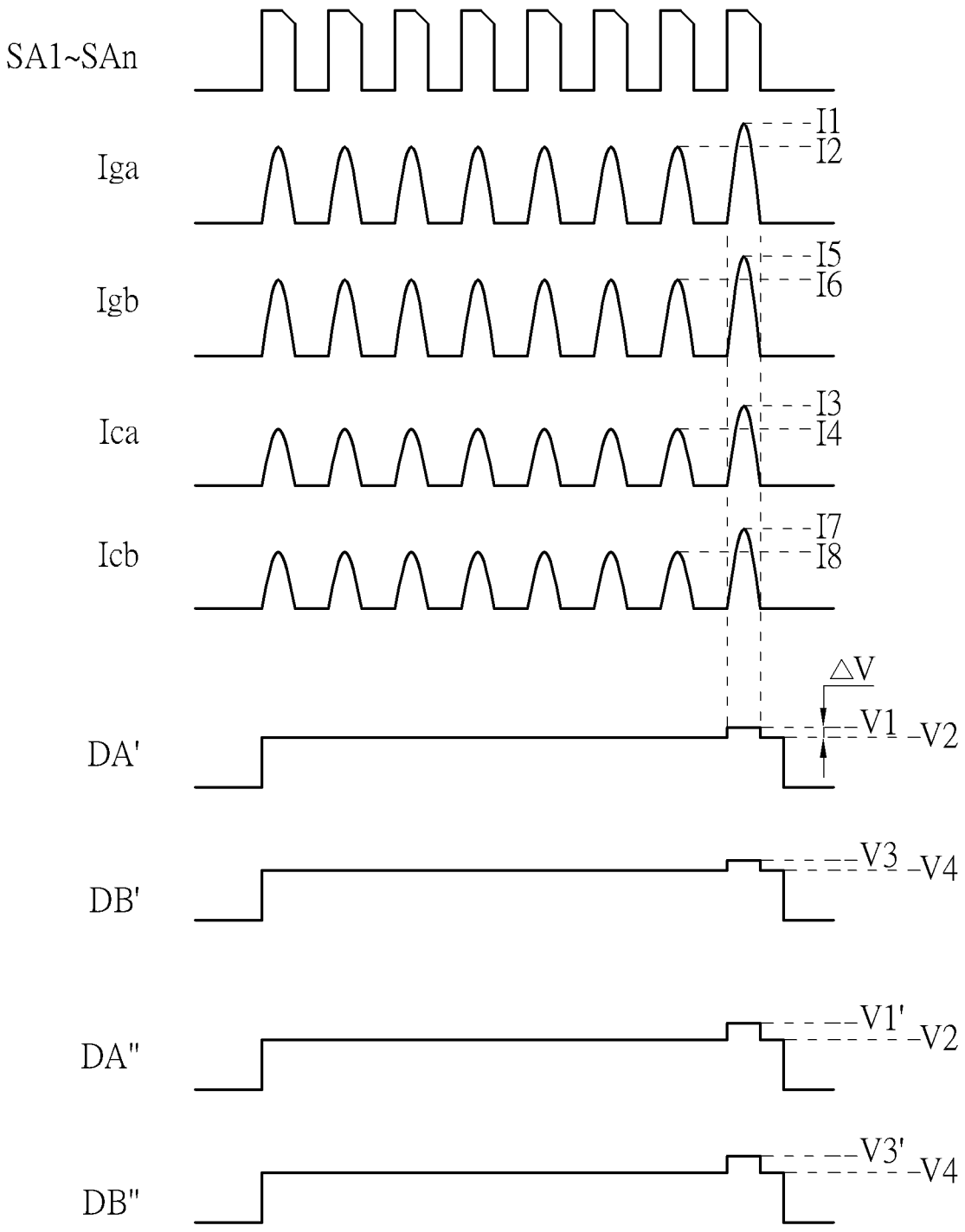

Please refer to FIG. 12 to FIG. 13, and please also refer to FIG. 2A. FIG. 12 to FIG. 13 are schematic diagrams illustrating a driving method of the display panel according to a third embodiment of the present disclosure. As shown in FIG. 12, as compared to the second embodiment, the display device DD further includes a power controller PI electrically connected to the display panel 600 and the timing controller TC for providing a power signal to the display panel 600. In this embodiment, the display panel 600 is first provided, wherein it may be disposed in the display region DR, as shown in FIG. 1. And then, the display panel 600 is driven. For example, a plurality of first gate signal SA1~SAn are sequentially provided to the first gate lines GLA according to the arranged sequence of the first gate lines GLA1~GLAn, and a plurality of second gate signal SB1~SBm are sequentially provided to the corresponding second gate lines GLB according to the arranged sequence of the first gate lines GLB1~GLBm, the first data signal DA is provided to one of the first data lines DLA, and the second data signal DB is provided to one of the second data lines DLB.

Subsequently, when the display panel 600 is driven, the timing controller TC is utilized to measure a current signal Iga of each of the first gate lines GLA, so as to have a first current I1 of the first gate line GLAn closest to the second circuit 102*b* and a second current I2 of one of the first gate lines GLA2~GLA(n−1) not closest to the second circuit 102*b* and not furthest from the second circuit 102*b*. Or, the timing controller TC may be utilized to measure a current signal Ica of each of the first common lines CLA, so as to have a third current I3 of the first common line CLA closest to the second circuit 102*b* and a fourth current I4 of one of the first common lines CLA not closest to the second circuit 102*b* and not furthest from the second circuit 102*b*. The circumstance of the display panel 600 being driven means that the display panel 600 is operated normally. In this embodiment, the timing controller TC may further measure a current signal Igb of each of the second gate lines GLB to have a fifth current I5 of the second gate line GLBm closest to the first circuit 102*a* and a sixth current I6 of one of the second gate lines GLB2~GLB(nm−1) not closest to the first circuit 102*a* and not furthest from the first circuit 102*a*, or measure a current signal Icb of each of the second common lines CLA to have a seventh current I7 of the second common line CLB closest to the first circuit 102*a* and an eighth current I8 of one of the second common lines CLB not closest to the first circuit 102*a* and not furthest from the first circuit 102*a*.

Next, a first difference between the first current I1 and the second current I2 may be calculated, or a second difference between the third current I3 and the fourth current I4 may be calculated. In this embodiment, the display panel 600 may include a memory and a comparator. The memory may be used for recording the first current I1, the second current I2, the third current I3 and the fourth current I4, and the comparator may be used for calculating the first difference and the second difference. In this embodiment, the comparator may further be used for calculating a third difference between the fifth current I5 and the sixth current I6, or calculating a fourth difference between the seventh current I7 and the eighth current I8.

Thereafter, as shown in FIG. 13, based on the first difference or the second difference, the plurality of first data signals DA output to the first data lines DLA may be adjusted. That is to say, the first data signals DA is modified to the third data signals DA' when the first gate line GLAn closest to the second circuit 102*b* receives the first gate signal SAn again. For example, when the first pixels PXA corresponding to the third data signals DA' display the same gray level, the first voltage V1 of one of the third data signals DA' corresponding to the first gate line GLAn closest to the second circuit 102*b* are greater than or less than the second voltage V2 of one of the third gate signals DA' corresponding to one of the first gate lines GLA2~GLA(n−1) not closest to the second circuit 102*b* and not furthest from the second circuit 102*b*. In other words, the third data signals DA' are modified to be different from the first data signals DA to achieve a compensation effect. In this embodiment, the first voltage V1 is greater than the second voltage V2, and the difference ΔV between the first voltage V1 and the second voltage V2 may serve as the compensation value, but not limited thereto. Similarly, based on the third difference or the fourth difference, the plurality of second data signals DB output to the second data lines DLB are adjusted. That is to say, the second data signals DB are modified to the fourth data signals DB' when the second gate line GLBm closest to the first circuit 102*a* receives the second gate signal SBm again. When the second pixels PXB corresponding to the fourth data signals DB' display the same gray level, a third voltage V3 of one of the fourth data signals DB' corresponding to the second gate line GLBm closest to the first circuit 102*a* are greater than or less than a fourth voltage V4 of one of the fourth data signals DB' corresponding to one of the second gate lines GLB2~GLB(m−1) not closest to the first circuit 102*a* and not furthest from the first circuit 102*a*.

In addition, the first region 100*a* and the second region 100*b* in this embodiment may also be shown as FIG. 10. When the first gate line GLAn closest to the second circuit 102*b* receives the first gate signal SAn again, besides the first data signal DA provided to one of the first data lines DLA in the first sub region Ra is modified to be the third data signal DA', another first data signal DA provided to another one of the first data lines DLA in the second sub region Rb may be further modified to be another third data signal DA", wherein the first voltage V1 "of the third data signal DA" corresponding to the first gate line GLA closest to the second circuit 102*b* is greater than or less than the first voltage V1 of the third data signal DA. For example, the compensation value corresponding to the first pixel PXA in the first sub region Ra and closest to the second circuit 102*b* may be 1 gray level value, and the compensation value corresponding to the first pixel PXA in the second sub region Rb and closest to the second region 102*b* may be 1 or 2 gray level value. In this embodiment, the first pixels PXA in the first sub region Ra and the first pixels PXA in the second sub region Rb are electrically connected to different first data drivers 112*a* through different first data lines DLA. In this embodiment, the first region 100*a* may further include the fifth sub region Re and the sixth sub region Rf. When the display panel 600 is the single-side driving type, the compensation value corresponding to the fifth sub region Re and the compensation value corresponding to the sixth sub region Rf are greater than or equal to the compensation value corresponding second sub region R, and may be sequentially increased, as shown in FIG. 11.

Similarly, when the second gate line GLBm closest to the first circuit 102*a* receives the second gate signal SBm again, besides the second data signal DB provided to one of the second data lines DLB in the third sub region Rc is modified to be the fourth data signal DB', another second data signal DB provided to another one of the second data lines DLB in the fourth sub region Rd may be further modified to be another fourth data signal DB", wherein the third voltage V3' of the fourth data signal DB" corresponding to the second gate line GLB closest to the first circuit 102*a* is greater than or equal to the third voltage V3 of the fourth data signal DB'. In this embodiment, the second pixels PXB in the third sub region Rc and the second pixels PXB in the fourth sub region Rd are electrically connected to different second data drivers 112*b* through different second data lines DLB. Because the first region 100*a* and the second region 100*b* in this embodiment may be the same as that in the second embodiment, the compensating method used in the fifth sub region Re, the sixth sub region Rf, the seventh sub region Rg and the eighth sub region Rh of the second embodiment may be adapted to this embodiment, and will not described redundantly.

To sum up, the display panel of the present disclosure solves the problem of different gray levels displayed from different display regions or the problem of the occurrence of the horizontal dark lines in the middle of the pixels through the symmetry of the first circuit and the second circuit or through disposing the first dummy gate line. Or, the driving method provided in the present disclosure may further calculate the difference between the first current of the first gate line closest to the second circuit and the second current of one of the first gate lines not closest to the second circuit and not furthest from the second circuit or calculate the difference between the third current of the first common line closest to the second circuit and the fourth current of one of the first common lines not closest to second circuit and not furthest from the second circuit to compensate the corresponding data signals, so that the problem of different gray levels displayed from different display regions or the problem of the occurrence of horizontal dark lines in the middle of the pixels can be solved.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display panel, comprising:

a first circuit;

a second circuit, wherein the first circuit and the second circuit are disposed adjacent to each other and arranged along a first direction, and the first circuit and the second circuit are electrically insulated from each other; and a first dummy gate line extending along a second direction, wherein the first dummy gate line is disposed between the first circuit and the second circuit, and the first direction is different from the second direction.

2. The display panel of claim 1, further comprising a first gate driver and a second gate driver, wherein the first gate driver is electrically connected to the first circuit, the second gate driver is electrically connected to the second circuit, and the first dummy gate line is electrically connected to the first gate driver or the second gate driver.

3. The display panel of claim 2, further comprising a third gate driver and a fourth gate driver, wherein the third gate driver is electrically connected to the first circuit, and the fourth gate driver is electrically connected to the second circuit.

4. The display panel of claim 1, further comprising a second dummy gate line extending along the second direction, wherein the second dummy gate line is disposed between the first circuit and the second circuit.

5. The display panel of claim 4, further comprising a first gate driver and a second gate driver, wherein the first circuit and the first dummy gate line are electrically connected to the first gate driver, and the second circuit and the second dummy gate line are electrically connected to the second gate driver.

6. The display panel of claim 1, wherein the first circuit comprises a plurality of first gate lines extending along the second direction, the second circuit comprises a plurality of second gate lines extending along the second direction, and a number of the first gate lines is equal to a number of the second gate lines.

7. The display panel of claim 1, wherein the first circuit comprises a first gate line extending along the second direction and a first transistor, the second circuit comprises a second gate line extending along the second direction and a second transistor, the first transistor is electrically connected to the first gate line, the second transistor is electrically connected to the second gate line, and wherein the first transistor is disposed between the first gate line and the first dummy gate line, the second transistor is disposed between the second gate line and the first dummy gate line.

8. The display panel of claim 7, wherein the first circuit comprises a first voltage compensation line extending along the second direction, the second circuit comprises a second voltage compensation line extending along the second direction, the first voltage compensation line corresponds to the first gate line and the second voltage compensation line corresponds to the second gate line.

9. The display panel of claim 1, wherein the first circuit comprises a first gate line extending along the second direction and a first transistor, the second circuit comprises a second gate line extending along the second direction and a second transistor, the first transistor is electrically connected to the first gate line, the second transistor is electrically connected to the second gate line, the first gate line is disposed between the first transistor and the first dummy gate line, and the second gate line is disposed between the second transistor and the first dummy gate line.

10. The display panel of claim 1, wherein the first circuit comprises a first gate line extending along the second direction and a first transistors, the second circuit comprises a second gate line extending along the second direction and a second transistor, the first transistor is electrically connected to the first gate line, the second transistor is electrically connected to the second gate line, the first transistor is disposed between the first gate line and the first dummy gate line, and the second gate lines is disposed between the second transistor and the first dummy gate line.

11. The display panel of claim 1, wherein the first direction is perpendicular to the second direction.

12. A driving method of a display panel, comprising:

providing the display panel, wherein the display panel comprises a first circuit and a second circuit, the second circuit and the first circuit are adjacent to each other and arranged along a first direction, the first circuit and the second circuit are electrically insulated from each other, the first circuit comprises a plurality of first gate lines extending along a second direction, and a plurality of first data lines extending along the first direction, and the first data lines overlap the first gate lines;

measuring a first current of one of the first gate lines closest to the second circuit and measuring a second current of one of the first gate lines not closest to the second circuit and not furthest to the second circuit when the display panel is driven;

calculating a difference between the first current and the second current; and modifying a plurality of data signals output to the first data lines based on the difference.

* * * * *